US006365893B1

(12) United States Patent
Le Cocq

(10) Patent No.: US 6,365,893 B1
(45) Date of Patent: Apr. 2, 2002

(54) INTERNAL CALIBRATION OF TIME TO MASS CONVERSION IN TIME-OF-FLIGHT MASS SPECTROMETRY

(75) Inventor: Christian A. Le Cocq, Menlo Park, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/447,479

(22) Filed: Nov. 23, 1999

(51) Int. Cl.[7] ..... H01J 49/40; H01J 49/00; H01J 44/00

(52) U.S. Cl. ..... 250/287; 250/282; 250/283

(58) Field of Search ..... 250/287, 281, 250/282, 252.1, 363.09, 390.08, 424

(56) References Cited

U.S. PATENT DOCUMENTS 4,295,046 A * 10/1981 Guter et al. ..... 250/287
5,396,065 A * 3/1995 Myerholtz et al. ..... 250/287
5,847,385 A 12/1998 Dresch ..... 250/287
5,852,295 A 12/1998 Da Silveira et al. .... 250/423 R
5,869,830 A * 2/1999 Franzen et al. ..... 250/287
5,898,174 A 4/1999 Franzen ..... 250/287
5,905,259 A * 5/1999 Franzen ..... 250/287

* cited by examiner

*Primary Examiner*—Bruce Anderson
*Assistant Examiner*—Anthony Quash

(57) ABSTRACT

A technique for analyzing ions by determining the time of flight of the ions in a time of flight mass spectrometer using internal calibration. In the technique, a calibration step includes the steps of launching a packet of ions from a source to a detector, detecting the time needed for the ions to arrive at the detector to obtain a time-of-flight mass spectrum, and selecting data from the mass spectrum corresponding to a plurality of ions of consecutive masses and use the selected data to determine the relationship between time of flight data and the masses of the ions of consecutive masses for calibration of the relation between times of flight and masses in the mass spectrometer.

17 Claims, 2 Drawing Sheets

INTERNAL CALIBRATION OF TIME TO MASS CONVERSION IN TIME-OF-FLIGHT MASS SPECTROMETRY

FIELD OF THE INVENTION

The present invention relates to techniques for analyzing ions by time-of flight mass spectrometry, and more particularly to techniques for analyzing ions by mass spectrometry that involves calibration of a mass spectrometer.

BACKGROUND

Mass spectrometry is a significant tool useful for analyzing ions. The knowledge of the masses and relative abundance of the various fragments produced after a ionized compound breaks down helps an investigator in determining the chemical structure of an unknown compound. If the compound has been analyzed with mass spectrometry, searching a mass spectral library may help to identify the compound.

In traditional mass spectrometry, the ions go through an electrostatic, magnetic or electromagnetic (quadrupole for instance) filter that only lets through ions of a given mass. The ions are then detected. The filter is tuned to different masses and the experiment repeated until all the masses of interest have been measured. Sensitivity often is not as good as desired because at a given time, except those ions of the mass allowed through the filter, all others are discarded.

In time of flight mass spectroscopy (TOF-MS), a packet of ions is launched by an electrostatic pulse towards a detector a distance away. Ions having the same initial kinetic energy but different masses will separate when allowed to drift along a field-free region. The ions are given either equal momentum or equal energy, and they separate in flight according to their masses, the heavy ions arriving behind the light ions. By measuring the flight times, one can know the masses of the various ions in the packet. Because each packet contains only a few ions, the experiment is repeated many times and the measurements are summed in order to increase sensitivity. After a few hundred to many thousand cycles, which may take only a fraction of a second, the quality of the measurement is sufficient to identify the compound. The ions of all masses are analyzed in parallel instead of one mass at a time. Patents of general interest on TOF-MS include, for example, U.S. Pat. No. 5,847,385 (Dresch), U.S. Pat. No. 5,852,295 (Da Silveira et al.), and U.S. Pat. No. 5,898,174 (Franzen), which are incorporated by reference in their entireties herein.

A graph representing the mass spectrum results of TOF-MS showing ion abundance as a function of time of flight contains numerous peaks. To obtain the correct masses from a mass spectrum, one needs to convert the peaks in the mass spectrum to the corresponding masses. Such a conversion process, generally, involves a calibration step. Given a particular set of equipment, TOF-MS calibration would establish a time to mass conversion formula that a user will be able to obtain an ion abundance versus mass relationship from a mass spectrum, instead of an ion abundance versus time relationship. Typically, calibration of a mass spectrometer is done by the injection of a sample of known composition, for example, HCB (hexachlorobenzene) into the mass spectrometer. As an alternative, one may rely on the assumption that the residual signal in the absence of any analyte or unknown sample is from mostly air and water. In such cases one can recognize at least two peaks in the mass spectrum, then solve for the calibration equation. However, in many industrial circumstances, for example, in the production of semiconductor material, even trace amounts of contamination can be problematic and injecting a calibration compound increases the risk of contamination. Thus, there is a need for a calibration method without the introduction of calibration samples of a known chemical nature into the mass spectrometer.

SUMMARY

This invention provides techniques for analyzing ions by determining the time of flight of the ions from a source before detection at a detector. In this technique, the calibration of a time-of-flight mass spectrometer (TOF-MS) can be done without the introduction of calibration compounds of known chemical nature into the mass spectrometer. In one aspect, the present invention provides a method for internal calibration in a TOF-MS. To analyze ions by determining the time of flight of the ions from a source before detection at a detector in a TOF-MS, the present invention uses a calibration method that includes launching a packet of ions from a source to travel a distance to a detector, detecting the time of arrival of the ions at the detector to obtain a time-of-flight mass spectrum thereof, and selecting data from the mass spectrum corresponding to a plurality of ions of consecutive masses and using these selected data to determine the relationship between time of flight data and the masses of the ions of consecutive masses for calibration of the relation between the time of flight data and masses of ions in the mass spectrometer. In another aspect, the present invention provides a TOF-MS that can calibrate internally without the need for injecting a calibration compound of a known chemical nature. In such a TOF-MS, a processor determines the calibration by selecting data corresponding to a plurality of ions of consecutive masses and using these selected data to determine the relations of time of flight data and masses of ions.

The techniques of the present can be advantageously used for significantly increasing the reliability of TOF-MS. Applying the present technique of internal calibration, i.e., without the injection of a calibration compound of known chemical nature into the mass spectrometer, the risk of contamination is significantly reduced. Further, the present method can be used to compute the calibration quickly, since the present method requires no a priori knowledge on the instrument settings or the chemical being analyzed.

BRIEF DESCRIPTION OF THE DRAWINGS

The following figures are included to better illustrate the embodiments of the apparatus and technique of the present invention. In these figures, like numerals represent like features in the several views.

DETAILED DESCRIPTION

In one aspect of the invention, the present invention provides a technique for analyzing ions by TOF-MS in which calibration can be done without introducing calibration samples of a known nature into the mass spectrometer. The calibration according to the present invention involves an "internal calibration" technique in which data on ions of consecutive masses in an analysis of a sample are used as calibration standards for the sample.

Figure 1:
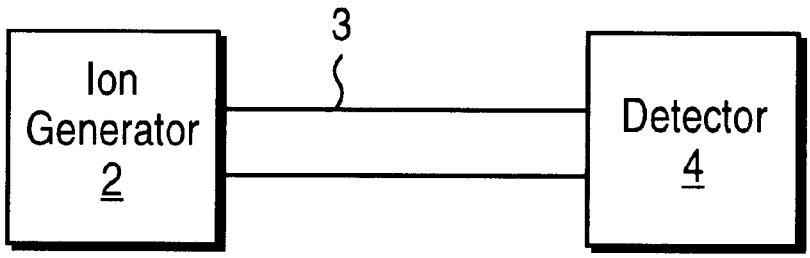
FIG. 1 shows a schematic view of a typical TOF-MS.
Figure 2:
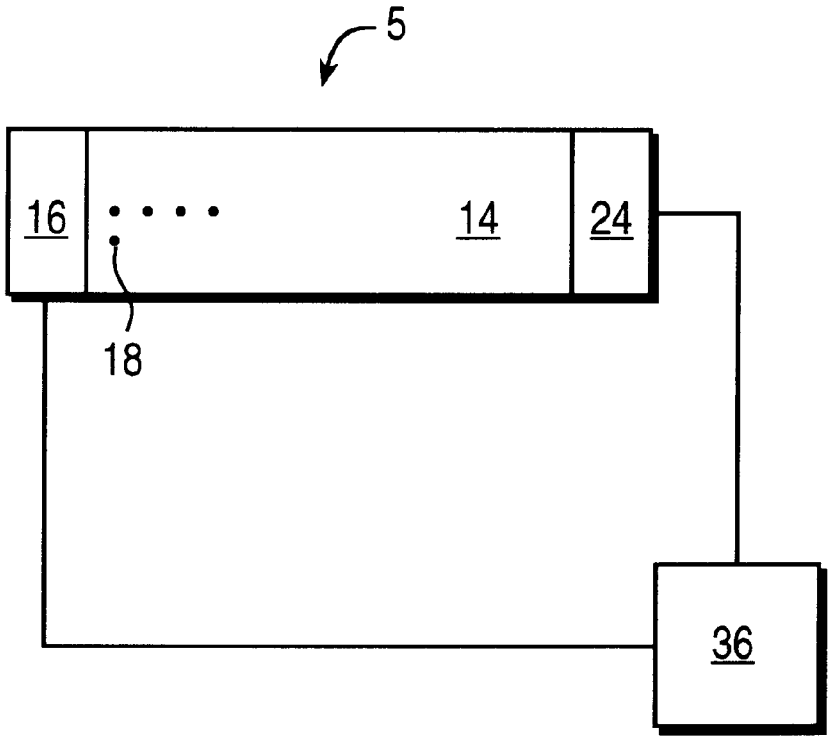
FIG. 2 shows a schematic view of an embodiment of an apparatus of the present invention.

FIG. 1 shows an example of a prior art time-of-flight mass spectrometer (TOF-MS), which includes a ion generator 2, which generates and propels ions through a flight tube 3 to a detector 4. FIG. 2 is a schematic representation showing an illustrative embodiment of a TOF-MS apparatus 5 according to the present invention. The apparatus 5 includes a flight channel (or flight tube) 14, in which ions can pass. An ion generator 16 generates and sends ions 18 down the fight channel 14 to a detector 24. The time of flight of the ions in the flight channel 14 can be analyzed to provide information on the analytical characteristics, such as the charge/mass ratio of the ions. Such information will in turn provide information on the analytical characteristics, such as the chemical makeup, of the source of ions, which can be a sample being analyzed. Techniques for causing samples to emit ions to be sent down the flight channel 14 are known in the art are will not be described in detail herein. Such techniques include, for example, matrix assisted desorption and ionization (MALDI), secondary ion mass spectrometry (SIMS), laser desorption (LD), plasma desorption (PD), electron impart ionization (EI), and inductively coupled plasma mass spectrometry (ICP-MS). Briefly stated, ions are produced when a sample in the ion generator 16 is impinged upon by energy, which may come from electron impact, laser light, plasma, or other sources of ions. For example, in MALDI, sample molecules of large molecular weight are stored in a sample support of low-molecular weight matrix substance. A laser light pulse focused onto the sample surface is used to vaporize a small amount of the matrix substance. Some sample molecules are carried along with the vaporized matrix substance and caused to ionized. The ions then travel down the flight channel and are analyzed. It is to be noted that the present invention is equally applicable regardless of the technique used for obtaining ions from a sample.

A processor 36 receives information from the ion generator (or ion source) 16 to determine the time the ions start down the flight channel 14. The detector 24 in the mass spectrometer apparatus 5 directs signals (detection signals) corresponding to the ions detected to the processor 36, which calculates the correlation between the detection signals and the signals from the ion generator 16. Based on the correlation results, the processor 36 provides information on the analytical characteristics of the ion generator 16. Flight times of the ions are converted into masses so that the identity of the ions can be determined.

Figure 3:
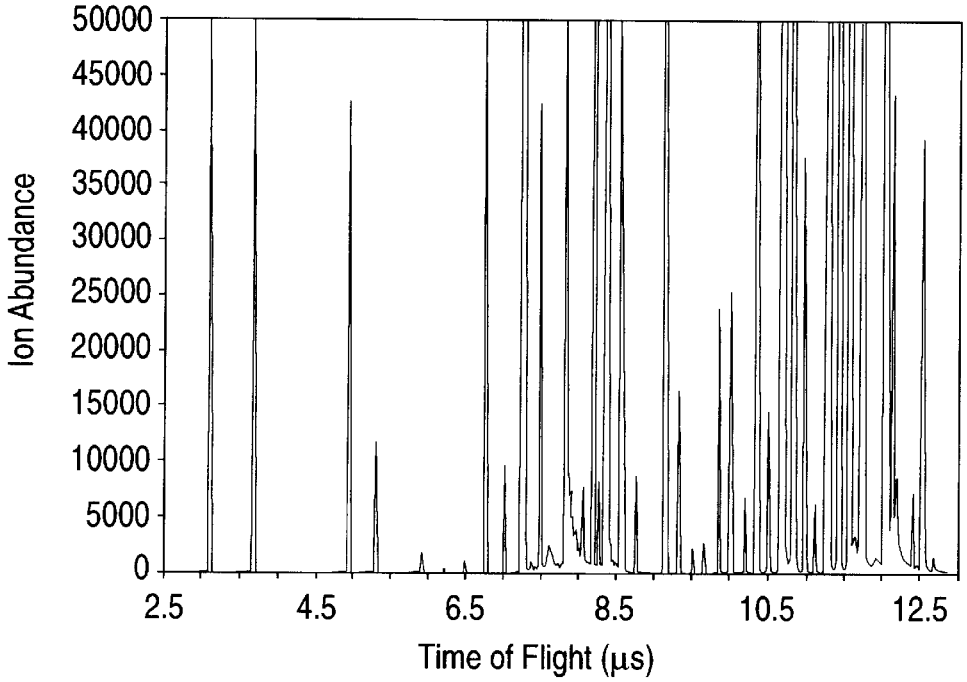
FIG. 3 is a graph of a typical TOF-MS mass spectrum showing the peaks representing ions of different masses.

In the processor 36, a calibration of the flight times to masses is done so that the flight times of the ions that are detected can be converted to masses to identify the ions generated from the sample. In the present invention, the calibration can be "internal" in that no calibration substance having a known chemical nature needs to be passed down the flight channel 14 to ascertain the flight time to mass relationship. Rather, the present technique uses the mass spectra generated by processing the sample to identify peaks with mass differences of one mass unit. In this way, knowing the flight time to mass conversion of one mass unit differences, the masses of other peaks can be converted to mass units. For illustration purposes, FIG. 3 is a TOF-MS mass spectrum of a sample showing many peaks representing ions of different masses. This mass spectrum is typical and representative of mass spectrometry in that there are many peaks. In FIG. 3 are many pairs of adjacent masses (i.e., pairs of ions that have peaks that are next to each other in the mass spectrum, such pairs are referred to as "mass-adjacent" herein). In an ideal TOF-MS, all ions are launched with the exact same energy E. These ions travel a distance L in the flight channel to the detector. Knowing the time $t_o$ at which an ion starts to traverse the distance L of the flight tube with energy E and the time t at which the ion is detected, to determine the mass m of the ion, the kinetic energy relationship can be represented as:

$$m = \frac{2E}{L^2} \cdot (t - t_o)^2 \qquad \text{Eq. (1)}$$

Since E and L are constant, let the ratio $$\frac{2E}{L^2}$$

be represented by a constant k, we obtain:

$$m = k \cdot (t - t_o)^2 \qquad \text{Eq.(2)}$$

In practice, if one makes a spectrum of the background material present in a spectrometer and integrates over a long enough period of time, one finds a spectrum with many low-level impurities, with almost one signal for every mass, up to mass 300 AMU (atomic mass unit). For a spectrum with many peaks, with the assumption that all adjacent peaks are produced by ions having consecutive masses (i.e., masses with one mass unit difference from their adjacent neighbors), rounding to the nearest integers, the mass-energy relationship for such ions with consecutive masses, for mass m, is $$m_i = k \cdot (t_i - t_o)^2 \qquad \text{Eq.(3)}$$

where i is the index referring to the sequence of detection peaks of the ions in the mass spectrum, $t_i$ is the time it takes for an ion corresponding to index i to reach the detector. Correspondingly, $t_{i+1}$ would be the time it takes for an ion corresponding to index i+1 to reach the detector.

Thus, similarly, for mass $m_{i+1}$, the relationship is:

$$m_{i+1} = k \cdot (t_{i+1} - t_o)^2 \qquad \text{Eq.(4)}$$

Therefore, for consecutive masses $$(t_{i+1} - t_o)^2 - (t_i - t_o)^2 = \frac{1}{k} \qquad \text{Eq. (5)}$$

For clarity, replace the constant 1/k with a difference constant C, we obtain $$(t_{i+1} - t_o)^2 - (t_i - t_o)^2 = C \qquad \text{Eq.(6)}$$

Expanding this equation, we obtain $$(t_{i+1})^2 - t_i^2 - 2t_o(t_{i+1} - t_i) = C \qquad \text{Eq.(7)}$$

For masses that are truly consecutive (e.g., such masses are one AMU apart from adjacent masses), $(t_{i+1}^2 - t_i^2)$ is proportional to $(t_{i+1} - t_i)$.

However, in practice, mass spectra do not always contain all masses that are consecutive to the others. Thus, to find C and $t_o$ from a mass spectrum, we find for all adjacent peaks the line that fits best through the mass pairs in the graph of:

$$(t_{i+1}^2 - t_i^2, t_{i+1} - t_i)$$

Figure 4:
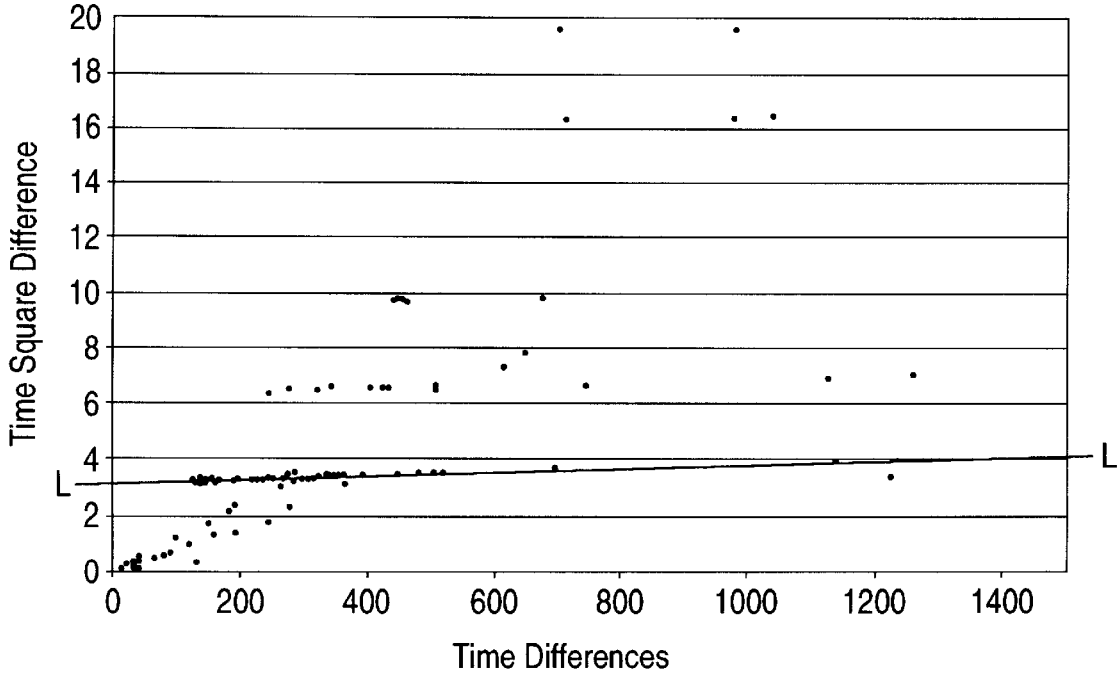
FIG. 4 is a graph showing the $(t_{i+1}^2-t_i^2)$ to $(t_{i+1}-t_i)$ relationship for pairs of adjacent peaks in the mass spectrum of FIG. 3.

Because some of the pairs may not correspond to ions that are one mass unit apart, curve-fitting (e.g., via linear regression) through all the pairs may result in erroneous conclusions. Some adjacent pairs may also be due to ringing after a peak. We have found that to obtain a formula for calibration, a good way is to construct a linear line that passes through or near to the maximum number of pairs. This can be done, for example, by linear regression. It is to be understood that one skilled in the art will be able to fit curves to data points using other statistical methods in view of the present disclosure. One way of implementation of this curve-fitting scheme is by comparing the lines that pass through every group of 5 adjacent peaks. Among these lines, the line that passes through or close to the largest number of points is retained as the best line. This technique is based on the observation that in pairs of adjacent masses there are more pairs that are consecutive in mass than pairs of other mass differences. This technique is illustrated in FIG. 4, which is a plot of the data of FIG. 3. In FIG. 4, the abscissa is time difference $(t_{i+1}-t_i)$ and the ordinate is time square difference $(t_{i+1}^2-t_i^2)$. Each point on the graph in FIG. 4 corresponds to a pair of adjacent peaks in the mass spectrum of FIG. 3. Line LL passes through or is close to the largest number of points in the graph and represents the equation Eq. 7 above. Therefore, it is clearly shown that the present invention can obtain the calibration of a TOF-MS with internal calibration without resorting to the injection a calibration compound. With the present technique, data are selected from the mass spectrum corresponding to a plurality of ions of consecutive masses. The selection is based on a substantially linear relationship between data points of $(t_{i+1}^2-t_i^2)$ to $(t_{i+1}-t_i)$. The selected data are used to determine the relationship between the time of flight and the masses of the ions for calibration of the relation between time of flight and masses in the mass spectrometer.

Once a first values of k and $t_o$ in the above equations have been computed one can compute an approximate mass for all the peaks. A finer calibration can be obtained from doing a linear regression between all the times $t_i$ and finer approximate masses versus using rounded integer masses as a close approximation to the exact masses. It is understood that the graphical representation of FIG. 4 is shown only for illustration purposes and that the calculation can be computed entirely by mathematics by a computer or even by hand without plotting a graph physically. The present technique works particularly well if there are several clusters of peaks with consecutive masses spread over the spectrum. Such spread out consecutive masses data will result in a line that spans over a wide range of $(t_{i+1}^2-t_i^2)$ and $(t_{i+1}-t_i)$ values, thereby giving a more accurate valuation of k and $t_o$. In practice, the present technique has been shown to work well with a dozen peaks. Most spectra, in fact, most background spectra, have many more peaks than that and therefore very suitable for the application of the present invention.

Although the preferred embodiment of the present invention has been described and illustrated in detail, it is to be understood that a person skilled in the art can make modifications, especially in size and shapes of features within the scope of the invention. For example, instead of using consecutive masses of one mass unit apart, one can do calculation by considering masses of two mass units apart, and the like and treat them as being consecutive for the purpose of fitting equation eq.(7).

What is claimed is:

1. An internal calibration method for analyzing ions by a mass spectrometer, said internal calibration method comprising:

(a launching a packet of ions from a source to travel a distance L to a detector, the packet of ions having ions of a plurality of masses, at least some of said ions have consecutive masses;

(b detecting the time of arrival of the ions at the detector to obtain a time-of-flight mass spectrum thereof; and (c selecting data from the mass spectrum corresponding to a plurality of ions of consecutive masses having adjacent peaks and using said data to determine a relationship between times of flight and the masses of the ions in order to calibrate the relation between times of flight between said adjacent peaks and masses in the mass spectrometer.

2. The method according to claim 1 wherein the packet of ions includes ions having masses differing from mass-adjacent ions by more than consecutive masses.

3. The method according to claim 2 wherein the selecting of data from the mass spectrum comprises grouping data according to a property and selecting the group with the largest number of members to be the data corresponding to ions of consecutive masses.

4. The method according to claim 3 further comprising grouping data according to a substantially linear relationship between data points of $(t_{i+1}^2-t_i^2)$ to $(t_{i+1}-t_i)$, where i is the index referring to the sequence of detection peaks of the ions in the mass spectrum, $t_i$ is the time it takes for an ion corresponding to index i to reach the detector and $t_{i+1}$ is the time it takes for an ion corresponding to index i+1 to reach the detector.

5. The method according to claim 3 wherein the calibration method further comprises finding a constant $t_o$ and a constant k in the relationship $$(t_{i+1}^2-t_i^2)-2t_o(t_{i+1}-t_i)=1/k$$

where i is the index referring to the sequence of detection peaks of the ions in the mass spectrum, $t_i$ is the time it takes for an ion corresponding to index i to reach the detector and $t_{i+1}$ is the time it takes for an ion corresponding to index i+1 to reach the detector, $t_o$ is the time the ions start traversing the distance L, k is a conversion constant relating to the kinetic energy.

6. The method according to claim 5 further comprising performing a linear regression analysis on the selected data points to determine $t_o$ and k.

7. The method according to claim 1 further comprising determining the masses of the ions in the packet of ions by using the relation between time of flight and masses in the mass spectrometer obtained by said internal calibration.

8. The method according to claim 1 wherein said internal calibration of said mass spectrometer is done without the introduction of a calibration compound of known chemical nature into said mass spectrometer.

9. A method for calibrating a time of flight mass spectrometer without introducing a calibration compound of known chemical nature, the calibration method comprising:

(a launching a packet of ions from a source to travel a distance L to a detector, the packet of ions having a plurality of masses, some of said ions having masses differing from other ions by more than consecutive masses and at least some of said ions in the packet have consecutive masses;

(b detecting the time of arrival of the ions at the detector to obtain a time-of-flight mass spectrum thereof; and (c selecting data from the mass spectrum corresponding to a plurality of ions of consecutive masses having adjacent peaks and using said data to determine a relationship between time of flight and the masses of the ions for calibration of the mass spectrometer, said selection being based on a substantially linear relationship between data points of $(t_{i+1}^2-t_i^2)$ to $(t_{i+1}-t_i)$ where i is the index referring to the sequence of detection peaks of the ions in the mass spectrum, $t_i$ is the time it takes for an ion corresponding to index i to reach the detector and $t_{i+}1$ is the time it takes for an ion corresponding to index i+1 to reach the detector.

10. An apparatus, having internal calibration, for analyzing a sample by time of flight mass spectrometry, said apparatus comprising:

(a an ion generator for launching packets of ions from a sample to travel a distance L in a flight tube to a detector;

(b a detector for detecting the time of flight of the ions for traversing the distance L, the time of flight of the ions of each packet can be determined to obtain a mass spectrum, the mass spectrum being indicative of the analytical characteristics of the ions; and c. a processor for selecting data from the mass spectrum corresponding to a plurality of ions of consecutive masses having peaks with a mass difference of one mass unit and for using said data to calibrate the apparatus by determining a relationship between the time of flight and the masses of the ions in the apparatus.

11. The apparatus according to claim 10 comprising means for generating the packet of ions, the packet of ions include ions having consecutive masses and ions having masses differing from mass-adjacent ions by more than consecutive mass.

12. The apparatus according to claim 10 wherein the processor selects data from the mass spectrum by grouping data according to a property and selecting the group with the largest number of members to be the data corresponding to ions of consecutive masses.

13. The apparatus according to claim 10 wherein the processor selects the data from mass spectrum via grouping data from the mass spectrum according to a substantially linear relationship between data points of $(t_{i+1}^2-t_i^2)$ versus $(t_{i+1}-t_i)$, where i is the index referring to the sequence of detection peaks of the ions in the mass spectrum, $t_i$ is the time it takes for an ion corresponding to index i to reach the detector and $t_{i+1}$ is the time it takes for an ion corresponding to index i+1 to reach the detector.

14. The apparatus according to claim 10 wherein the processor calibrates the apparatus via finding a constant $t_o$ and a constant k in the relationship $$(t_{i+1}^2-t_i^2)-2t_o(t_{i+1}-t_i)=1/k$$

where i is the index referring to the sequence of detection peaks of the ions in the mass spectrum, $t_i$ is the time it takes for an ion corresponding to index i to reach the detector and $t_{i+1}$ is the time it takes for an ion corresponding to index i+1 to reach the detector, $t_o$ is the time the ions start traversing the distance L, k is a conversion constant relating to the kinetic energy.

15. The apparatus according to claim 10 wherein the processor performs a linear regression analysis on the selected data points to determine $t_o$ and k.

16. The apparatus according to claim 10 wherein the processor determines the masses of the ions in packet by using the relation between time of flight and masses in the mass spectrometer obtained by said calibration.

17. The apparatus of claim 9 wherein said internal calibration is done without the introduction of a calibration compound of known chemical nature into said apparatus.

* * * * *